United States Patent [19]

Wood

[11] 4,079,549

[45] Mar. 21, 1978

[54] BALANCE SPRING LOCK FOR TILT OUT SASH

[75] Inventor: Edward H. Wood, Sanford, N.C.

[73] Assignee: Jim Walter Corporation, Tampa, Fla.

[21] Appl. No.: 717,933

[22] Filed: Aug. 26, 1976

[51] Int. Cl.[2] ..... E05D 15/22

[52] U.S. Cl. ..... 49/181; 49/446; 49/453

[58] Field of Search ..... 49/181, 446, 453, 174

[56] References Cited

U.S. PATENT DOCUMENTS

| | | | |
|---|---|---|---|
| 3,055,062 | 9/1962 | Peters et al. | 49/181 X |
| 3,676,956 | 7/1972 | Taylor et al. | 49/181 X |
| 3,789,549 | 2/1974 | Yip | 49/181 |
| 3,797,168 | 3/1974 | Trout | 49/181 |
| 3,978,617 | 9/1976 | Eventoff | 49/453 X |

*Primary Examiner*—Philip C. Kannan

*Attorney, Agent, or Firm*—Schroeder, Siegfried, Ryan, Vidas & Steffey

[57] ABSTRACT

This invention relates to a balance spring lock for tilt out windows in which the balance spring is positioned in the jamb channel and connected through a sash cord to a block member and to the frame. The sash cord is directed over a sheave and either through an aperture in the block or guided along the surface of the block to be clamped against the block or within the block upon rotation of a shaft member therein coupled through a pin to the sash. The clamping action takes place through an eccentric surface on the shaft member through a cam follower operated by the shaft member, or through a pivoted lever attached to the shaft member. All variations of the clamping action operate with rotation of the shaft member caused by tilt of the window.

19 Claims, 8 Drawing Figures

BALANCE SPRING LOCK FOR TILT OUT SASH

This invention relates to sliding sash type windows and more particularly to an improved balance spring lock for a window of this type in which the sash is tilted or pivoted between a vertical and horizontal position to effect locking of the balance springs in the jambs for repair, cleaning, or removal of the sash.

A pivoted or tilt out sash type window in which the sash slides vertically in a window frame is well know. The application of balance assemblies or springs to such sash and the connection or disconnection of the same when the window is tilted out for repair, cleaning, or removal of the sash, have taken a variety of forms. These have included various catches positioned in a jamb channel of the window frames and special friction locks anchoring the balance springs and connecting the same to the sash. Where special catches are incorporated into the window frames or jamb channels, the design of the tilt out window and the locking assembly for the balance system cannot be universally applied to wooden or metal frames interchangeably since special window frame constructions and sash constructions are required. Similarly, for balance assemblies with friction locks, the particular known designs have all required a special design of weather stripping, sash construction and frame construction for proper operation. These have resulted in complex structures which are not universal or interchangeably with the various types of windows. Generally, sash balance assemblies for such tilt out and take out windows have required either specific jamb constructions or special self-contained balance assemblies which are connected to the sash through a sash cord. The latter requires complex pulley arrangements to direct the sash cord from the balance assembly to the sash for the proper direction of application of the balance force to the sash. Such pulley arrangements increase the frictional load on the balance assemblies to limit the application of spring sizes in the balance assemblies and require separate balance assemblies for different bias forces with varying sized sash.

The present invention is directed to a simplified balance spring lock for use with a tilt out sash in which a separate housing for the balance spring and the connection for the sash is not required. This permits ready interchange of spring sizes for varying sized sash applications and eliminates the need of a complex pulley system to direct the spring force in a proper direction. The latter minimizes the frictional forces in the balance assembly. The improved balance spring lock may be readily applied to all channel constructions and with various weather stripping configurations. It is readily coupled to the sash for operation on tilt out of the sash to lock the balance spring in place in the jamb channel so that the sash may either be removed or held in position for repair or cleaning. The improved balance spring lock includes a floating block to which one end of the balance spring is attached through a sash cord with a simple pulley or sheave. The other end of the sash is secured to the jamb channel and the opposite end of the balance spring is also secured to the jamb channel. The sash cord is directed through or in common with the block, and a suitable mechanism, either a lever or camming type lock, will hold the sash cord to the block to retain the block in position in the jamb channel upon the tilt of the sash. Such an arrangement does not require accurate dimensional tolerances in either the sash or the jamb channels in the window frame which are present in known types of frictional locks with tilt out window assemblies. For this reason, the present balance spring lock is applicable to any type of wood or metal frame and sash. It is coupled to the sash by a key on the sash positioned in a key slot in a pivoted shaft of the block so that the sash may be lifted out of the block if the window is to be of the take out type, or the sash may be connected to the block in a relatively permanent type pivot structure which merely performs the locking function.

Therefore, it is the principle object of this invention to provide an improved balance spring lock which is applicable to all types of window designs.

Another object of this invention is to provide an improved balance spring lock which performs a positive locking function upon tilt of the sash and may be readily applied to take out as well as permanently installed windows.

A further object of this invention is to provide a simplified balance spring lock which does not require a special balance spring assembly, thereby facilitating a ready interchange of springs for varying spring rates in the balance assembly.

Another object of this invention is to provide an improved balance spring lock which may be readily applied to a sash through a simplified sash cord, and pulley connection arrangement with a minimal of frictional force in the pulley arrangement.

It is also an object of this invention to provide an improved balance spring lock which may be readily applied to take out or tilt windows and to either single or double hung sash.

A still further object of this invention is to provide a simplified balance spring assembly which is durable, relatively inexpensive, and is easy to install.

These and other objects of the invention will become apparent from the reading of the attached description together with the drawings wherein.

Figure 1:
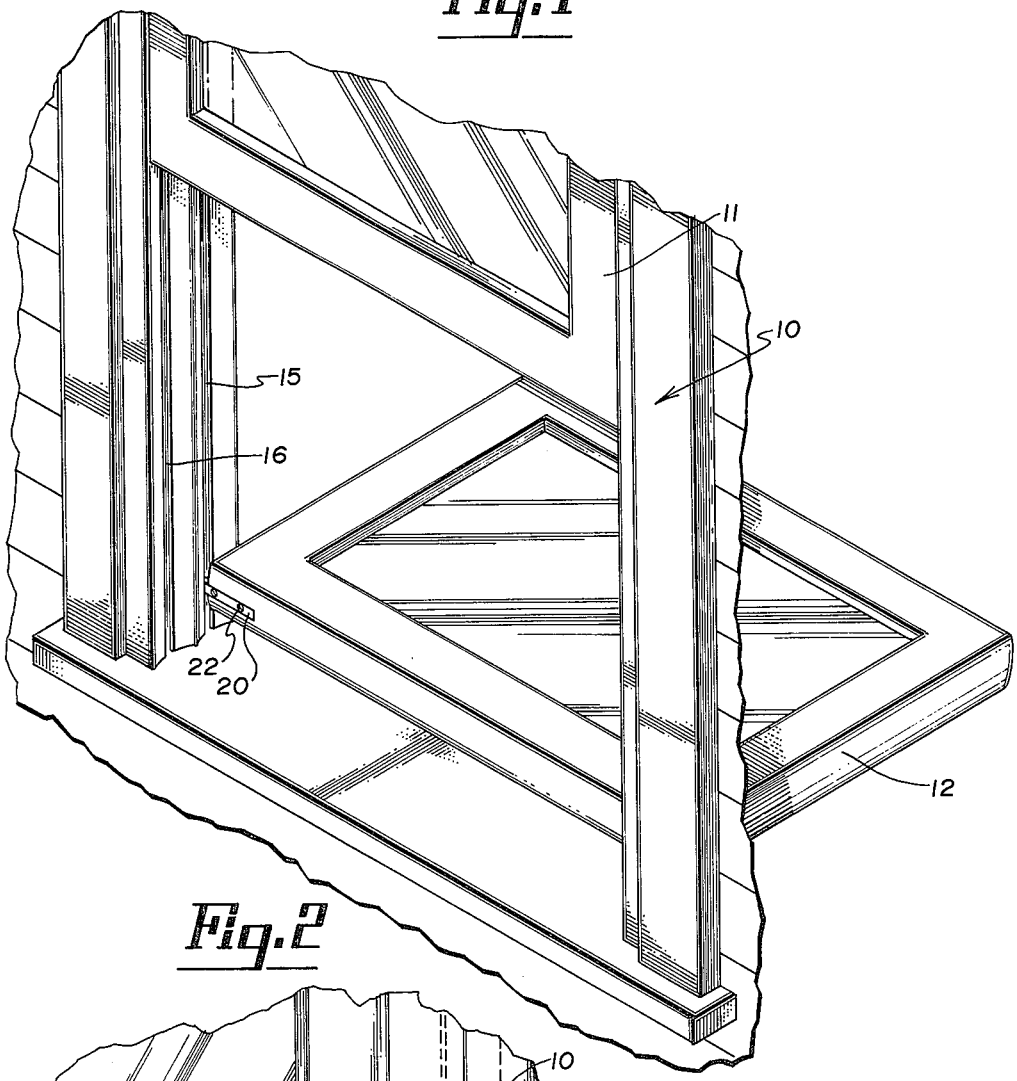
FIG. 1 is a perspective view of a double hung window with one sash in a tilted position.

The improved balance spring lock is shown in connection with a double hung tilt out type window in FIG. 1. The frame of the window, indicated generally at 10, incorporating sashes 11 and 12 which are slidably mounted in jamb channels indicated generally at 15 and 16 respectively. Such jamb channels are parallel to one another in the frame and the individual sash slides vertically therein between a closed and open position. Conventionally, each sash has a balance spring assembly associated therewith on either side of the sash and in the respective jamb channels in which the sash slides. As shown in FIG. 1, the lower sash 12 is shown in a tilted position. With such tilt of the sash the improved balance spring lock operates to remove the tension of the balance spring on the sash by locking the balance assembly in the position in which the sash is tilted so that it will not move in the jamb channel. As heretofore noted, the invention is equally applicable to wood or metal windows. The sash is normally tilted out of the vertical jamb channel for maintenance purposes such as cleaning, although the structure may be a take out window in which the sash may be readily removed from the window frame.

Figure 2:
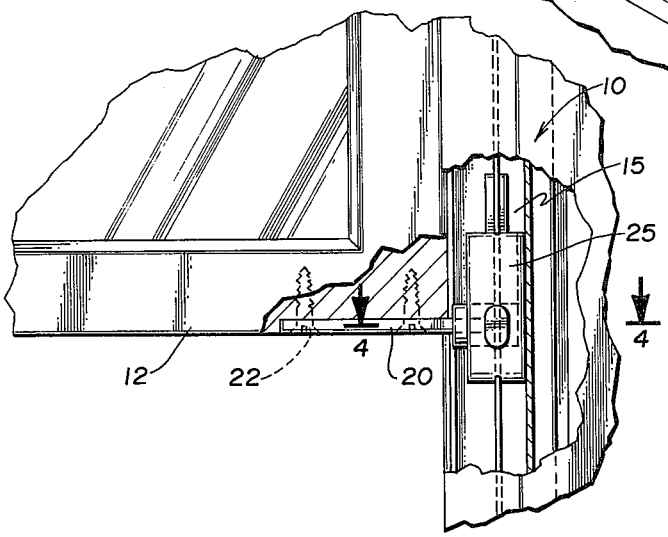
FIG. 2 is an elevational view of a portion of a window showing the connection of one side of a sash to the spring balance lock, with parts broken away.
Figure 3:
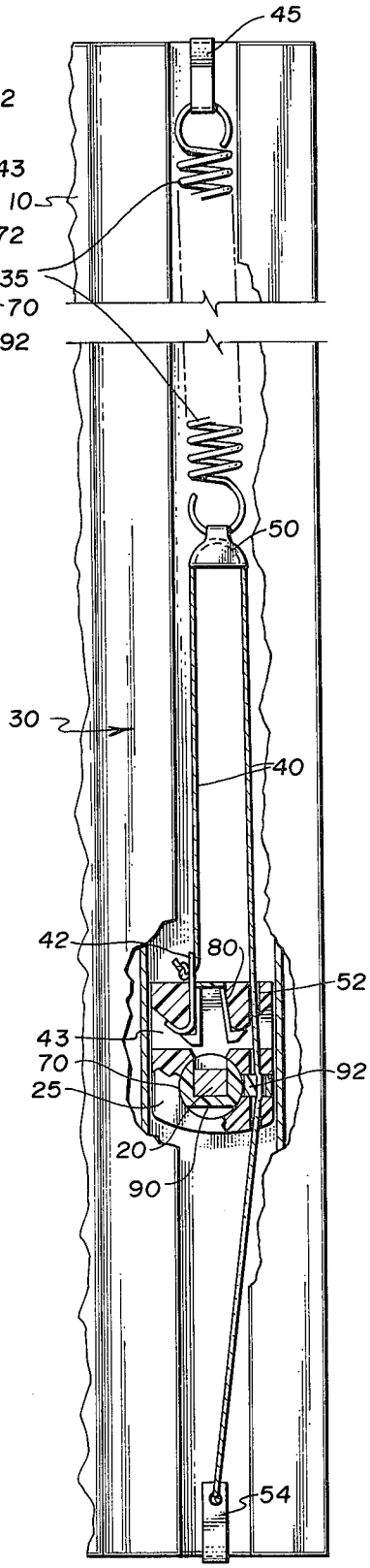
FIG. 3 is an elevation view of one side of a window frame showing the balance system with parts broken away.

As shown in FIGS. 1 and 2, window sash 12 has a pin 20 on each side of the sash projecting into a block 25 of the lock for the balance spring assembly, which is generally at 30 in FIG. 3. The pin 20 is secured to the lintel of the sash by any suitable means, such as screw 22. Such pins are secured to the sash upon installation of the sash in the window frame.

As will be best seen in FIG. 3, the balance spring assembly for each side of the sash and for each of the sash in the frame, should there be a double hung window, includes basically a tension spring or coil spring 35 coupled to the block or lock member 25 through a sash cord indicated at 40. One end of the tension spring is connected by a hook 45 to the frame or weather stripping with the opposite end of the coil spring being connected to a sheave or pulley 50 around which the sash cord extends. The sash cord includes a hook 42 at one end which hook is positioned in a slot 43 of the block 25. The sash cord is directed through an aperture or hole 52 which is drilled longitudinally through the block 25 with the opposite end of the sash cord carrying a hook 54 which is secured to the frame or weather stripping at the opposite end of the channel.

Figure 4:
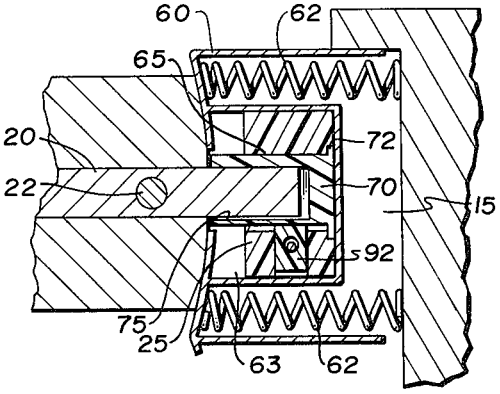
FIG. 4 is a sectional view of the view of FIG. 2 taken along the lines 4—4 therein.

The sash balance assembly or the parts for the same merely are positioned in the jamb channel or in the notched surface in the weather stripping, as will be seen in FIG. 4, as separate parts interconnected to one another and independent of any special housing or frame for connecting the same. Thus, any size spring may be incorporated with the sash cord and lock to meet any lifting requirements of varying sash weights and sizes. Similarly, any type of spring, such as Torque Master Sash Balance manufactured by the W. & F. Manufacturing, Inc., of Dallas, Tex. may be employed in place of conventional coil springs. As will be seen in FIG. 4, suitable weather stripping such as is indicated at 60 may be included in the jamb channel with bias springs 62 behind the same and a recessed or grooved surface 63 in which the balance spring assembly 30 is positioned. This will permit displacement of the weather stripping whenever the window is rotated to tilt out the window. Where weather stripping is used, the hooks 45, and 54 may be attached to the suitable notches in the same or to the ends of the same.

The block 25 of the balance spring lock is generally rectangular in form and includes an aperture 65 extending through the same. A shaft member 70 is positioned in the aperture 65 which shaft member has a collar 72 at one surface of the same to guide and position the shaft member in the aperture. The shaft member has a "U" shaped notch 75 extending part way through the same which is generally rectangular in cross section and which receives and holds the square or rectangular cross section of the pin 20 to couple the sash to the balance assembly and rotate the shaft with sash tilt. Similarly, the block 25 has a recessed surface 80 common to the slots 43 in one of which hook 42 on the end of the cord is positioned.

Figure 5:
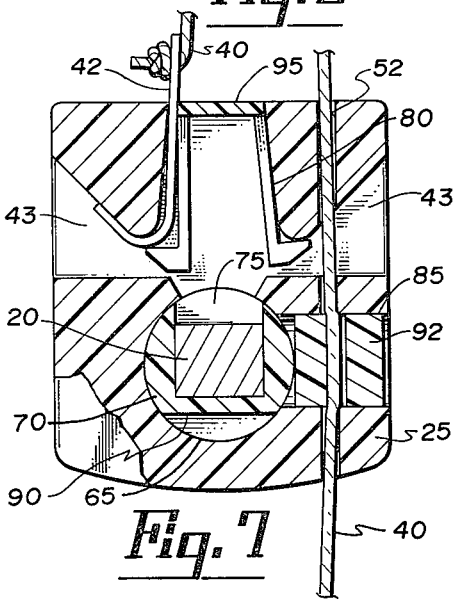
FIG. 5 is a plan view of the block of the spring balance lock with parts broken away.
Figure 6:
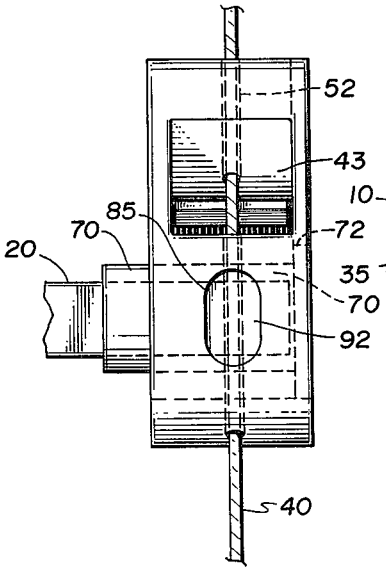
FIG. 6 is an end view of the balance spring lock in FIG. 5.

As will be seen in FIGS. 5 and 6, the block 25 has a translational slot 85 cut through the middle of the block form one side thereof communicating with the aperture 65 therein. The aperture 52 is positioned longitudinally through the block to intersect the slot 85 for purposes to be later noted. The shaft member 70 has a flat surface 90 opposite the opening in the notch 75 and a suitable plug member 92 is positioned in the aperture 85 of the block to contact both the round and the flat surfaces of the shaft member. These form camming surfaces which move the plug member as a cam follower. Whenever the shaft 70 is rotated through 90° from a position in which the plug bears against the flat surface 90 to one in which the plug bears against the round surface of the shaft member, the plug 92 is moved translationally in the slot 85 and clamps the sash cord 40 against the surface of the block in the opening 85. In FIG. 5, the sash cord extends through an aperture in plug 92, but it will be understood that the plug may be of such a length to merely contact and clamp the sash cord in the block. This effectively clamps the sash cord to the block with tilt of the window causing rotation of the shaft member 70 to rotate the flat surface thereon out of contact with the plug 92. Thus, the sash cord is clamped to the block, and the end of the sash cord is secured to the jamb channel or weather stripping by the hook 54. This secures the balance spring and the block in the jamb channel removing the bias from the sash and preventing vertical movement of the sash in the window frame. A suitable plug member 95 may be positioned in the recessed surface 80 to secure the clip 42 on the end of the sash cord in the slotted surface 43 of the block and also cover the end of the "U" shaped recess 75 of the shaft to retain the pin 20 of the sash in the block. Whenever it is desired to remove the window, this plug may be removed, and the tilt out sash may be taken out of the window frame. It will be understood that similar balance assemblies are used on both sides of the sash or in the jamb channels in the frames mounting the sash for sliding movement therein, and the structure positioned in the jamb channels in either side of the sash and guiding the sash thereon will be identical in construction and operation. The use of the single sheave or pulley 50 minimizes frictional forces on the sash cord to significantly reduce frictional loses on the balance system, and the sliding block 25 and balance spring may be readily positioned into window frames of varying sizes since the frictional forces required for locking the same do not depend upon contact of the block with the sides of the jamb channel or with the sash.

Figure 7:
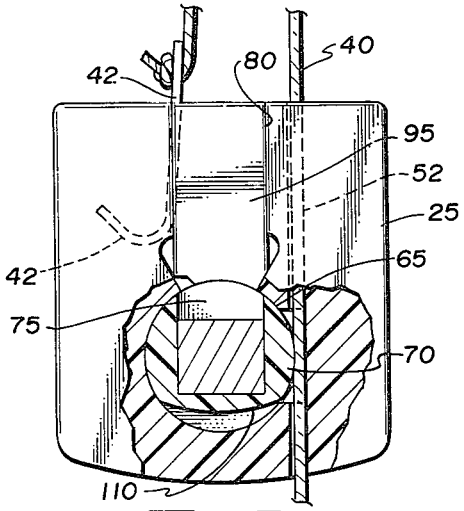
FIG. 7 is a plan view of an alternative embodiment of the balance spring lock with parts broken away.

An alternate embodiment of the lock is shown in FIG. 7 in which the block 25 with the aperture 65 therethrough has the shaft member 70 in which the flat surface 90 is replaced by a curved surface 110. The curved surface 110 is an arc having a radius of curvature eccentric with the general radius of the cylindrical shaft member. The shaft has the rectangular notched recess surface 75 therein and the hook 42 is positioned in the recess 80 in the block being secured in a slotted surface 43 therein. In this embodiment, the aperture 52 for the sash cord 40 is disposed adjacent to and abutting the curved surface 110 of the shaft member 70. Thus, whenever the shaft member is rotated with the tilt out of the window, the round surface of the shaft member will bear against the sash cord 40 exposed in its aperture 52 such that the sash cord will be clamped in the block.

Figure 8:
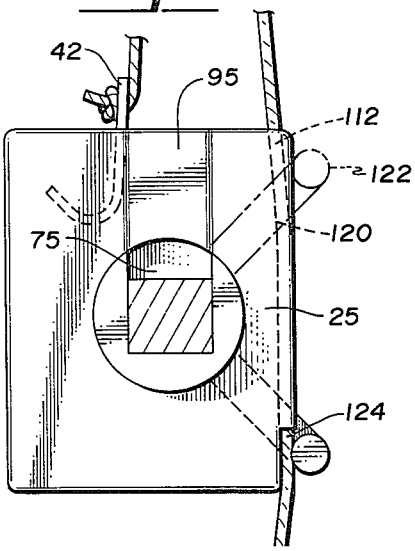
FIG. 8 is a plan view of another embodiment of the balance spring lock.

The embodiment of FIG. 8 is another version of the lock in which the sash cord 40 is directed along the edge of the block 25 and in a notched surface 112 therein. The shaft member 70 with its notched surface 75 has a lever member 120 connected at the collar 72 of the shaft member. The lever is secured to the collar 72 to be disposed on the back side of the block 25 and rotate with the shaft member 70 upon window tilt. The lever member has a transversely extending arm portion 122 disposed along the side edge of the block which portion serves to hold the sash cord in the grooved surface 112 in the side edge of the block. The lower surface of the block has a recess 124 in the side edge and whenever the shaft member is rotated through a 90° arc, the lever member will be disposed from an upper position through a 90° rotation causing the transversely extending arm portion 122 to clamp the cord in the recess 124 of the side surface. This embodiment, like the previous embodiment, clamps the cord to the block and secures the balance system in a locked condition whenever the window is tilted. A similar arrangement of parts permitting the connection of the sash cord through its hook 42 to the block and the mounting of the pin 20 of the sash in the shaft member 70 is provided through the recess 75.

It will be understood that the improved balance spring lock of the present invention is applicable to all sizes and types of sliding sash in which the balance spring assembly is utilized to balance the same. A single jamb channel and balance assembly has been shown in the drawings to simplify the same, and it will be understood that the balance assemblies on either side of the sash will balance the same in the jamb channels of the window frame. Similarly, the frame and/or the sash may be of metal contruction or wood construction and the window may be single or double hung as desired. The improved balance spring lock permits a ready interchange of spring sizes or types, and the improved balance spring lock may be applied to any width of the jamb channel.

Therefore, in considering this invention, it should be remembered that the present disclosure is illustrative only, and the scope of the invention should be determined by the appended claims.

I claim:

1. A tilt out sash window comprising, a frame including side jambs, at least one sash having sides stiles sliding in the side jambs of the frame, a spring in each jamb having one end connected near the top of the jamb, a block slidably mounted in each of the jambs, a sash cord connected at one end to said block and to the opposite end of the spring through a guide means, said cord being slidably coupled back to the block with the opposite end of the cord being connected to the lower end of the jamb, means coupling said sash to said blocks in said jambs to move with the blocks and vary the length of the springs, and means within each block and connected to the means coupling said sash to the blocks to clamp each cord at the block whenever the sash is tilted to prevent sliding movement of the sash and the blocks in the jambs.

2. The tilt out sash window of claim 1 in which the means within the block is a pivot means pivotally mounted in the block and connected to the means coupling the sash to the block to urge the cord against the block.

3. The tilt out sash window of claim 1 in which the means within the block is a pivoted lever member journaled in the block and coupled to the cord to urge the cord against the block and prevent movement of the cord relative thereto upon tilt of the window and pivot of the lever member.

4. The tilt out sash window of claim 1 in which the guide means connecting the sash cord to the end of the spring is a pulley member mounted on the spring with a cord extending across the same.

5. The tilt out sash window of claim 1 in which the sash cord is a single length of cord extending at one end from the block to the spring and slidably coupled through the block being secured at the other end to the jamb.

6. The tilt out window of claim 1 and including a removable plug means positioned in the block and securing said one end of the cord to the block.

7. The tilt out sash window of claim 1 in which the sash cord is slidably coupled to the block by passing through an aperture therein.

8. The tilt out sash window of claim 2 in which the means within the block is an eccentric mechanism wedging the cord against the block within the aperture.

9. A tilt out sash window comprising, a frame having side jambs and at least one sash having side stiles sliding on the side jambs of the frame, a spring in each of the jambs to be coupled with the sash within the frame, block means slidably mounted in each of the jambs, sash cords connected respectively to one end to the block means and through guide means on the end of the springs being slidably coupled with the block means and having the opposite ends attached to the jamb, means coupling said sash to the block means in the jambs, and means within the block means and responsive to the tilting movement of the sash out of the frame to clamp the slidable coupling of the sash cords with the block means to prevent movement of the sash.

10. A balance spring lock for use in a vertical channel of a window having a sash therein comprising, a block slidably mounted in said channel, said block having a hole therein, a shaft means rotatably mounted in the hole in said block, a sash cord for applying tension from a balance spring to the block, means in the block for securing one end of the sash cord, means in the block for guiding the sash cord from the balance spring with vertical movement of the block in the channel, means for connecting the shaft means to the sash to apply the bias of the balance spring to the sash and to rotate the shaft means with tilt of the sash, and means for clamping the sash cord to the block and releasing the sash cord with varying positions of rotation of the shaft means.

11. The balance spring lock of claim 10 in which the means for clamping and releasing the sash cord to the block includes a lever member connected to the shaft means and engaging and releasing the sash cord in the guiding means in the block.

12. The balance spring lock of claim 10 in which the means in the block for securing one end of the sash cord is a plug means removably positioned in a recess in the block in which said sash cord is positioned.

13. The balance spring lock of claim 10 in which the block is generally rectangular in form and made of a plastic material.

14. The balance spring lock of claim 10 in which the means for clamping and releasing the sash cord is a camming surface on the shaft means and a cam follower slidably mounted in the block and engaging the sash cord in the block.

15. The balance spring lock of claim 14 in which the sash cord is positioned in an aperture in the cam follower.

16. The balance spring lock of claim 10 in which the means for connecting the shaft means to the sash is a key type recess in the shaft means extending from one end of the shaft means and adapted to receive and mount a key-like member carried by the sash.

17. The balance spring lock of claim 16 in which the means in the block for guiding the sash cord from the balance spring is an aperture through the block.

18. The balance spring lock of claim 17 in which the means for clamping and releasing the sash cord to the block are round and flat surfaces on the shaft means applying a clamping and releasing action to the sash cord in said aperture.

19. The balance spring lock of claim 17 in which the means for clamping and releasing the sash cord in the block are eccentric and round surfaces on the sash cord applying clamping and releasing action to the sash cord in said aperture.

* * * * *